United States Patent [19]

Wright et al.

[11] Patent Number: 4,751,620

[45] Date of Patent: Jun. 14, 1988

[54] NITE WRITER PAD

[76] Inventors: Ludie J. Wright, 818 SW. Ft King St., Ocala, Fla. 32674; George Spector, 233 Broadway, Rm. 3815, New York, N.Y. 10007

[21] Appl. No.: 918,845

[22] Filed: Oct. 14, 1986

[51] Int. Cl.[4] ..... F21V 33/00

[52] U.S. Cl. ..... 362/99; 362/296; 362/154; 108/23

[58] Field of Search ..... 362/98, 99, 53, 427, 362/429, 396, 154, 155, 285, 287, 133, 156; 108/23; 206/371

[56] References Cited

U.S. PATENT DOCUMENTS

| | | | |
|---|---|---|---|
| 1,818,855 | 8/1931 | Kroldrup | 362/99 |
| 1,889,373 | 11/1932 | Pereira | 362/99 |
| 2,955,194 | 8/1960 | Clyne | 362/99 |
| 3,381,122 | 4/1968 | Boyle | 362/99 |
| 3,826,910 | 7/1974 | Davis | 362/99 |
| 4,153,927 | 5/1979 | Owens | 362/99 |
| 4,414,613 | 11/1983 | Mayer | 362/396 |
| 4,700,634 | 10/1987 | Mills et al. | 362/98 |

FOREIGN PATENT DOCUMENTS

| | | | |
|---|---|---|---|
| 783450 | 4/1935 | France | 362/99 |

*Primary Examiner*—William A. Cuchlinski, Jr.
*Assistant Examiner*—D. M. Cox
*Attorney, Agent, or Firm*—George Spector

[57] ABSTRACT

A nite writer pad is provided to aid people who must write at night which consists of an adjustable lamp for illuminating a writing surface thereon when needed and a storage compartment for holding various types of writing equipment therein.

4 Claims, 1 Drawing Sheet

NITE WRITER PAD

BACKGROUND OF THE INVENTION

The instant invention relates generally to illuminated writing devices and more specifically it relates to a nite writer pad.

Numerous illuminated writing devices have been provided in prior art that are adapted to shine lights onto writing surfaces when used in the dark. For example, U.S. Pat. Nos. 1,818,855; 3,381,122 and 4,153,927 all are illustrative of such prior art. While these units may be suitable for the particular purpose to which they address, they would not be as suitable for the purposes of the present invention as heretofore described.

SUMMARY OF THE INVENTION

A primary object of the present invention is to provide a nite writer pad that will overcome the shortcomings of the prior art devices.

Another object is to provide a nite writer pad to aid people who must write at night by containing an adjustable lamp for illuminating a writing surface thereon when needed.

An additional object is to provide a nite writer pad that includes a storage compartment for holding various types of writing equipment therein.

A further object is to provide a nite writer pad that is simple and easy to use.

A still further object is to provide a nite writer pad that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
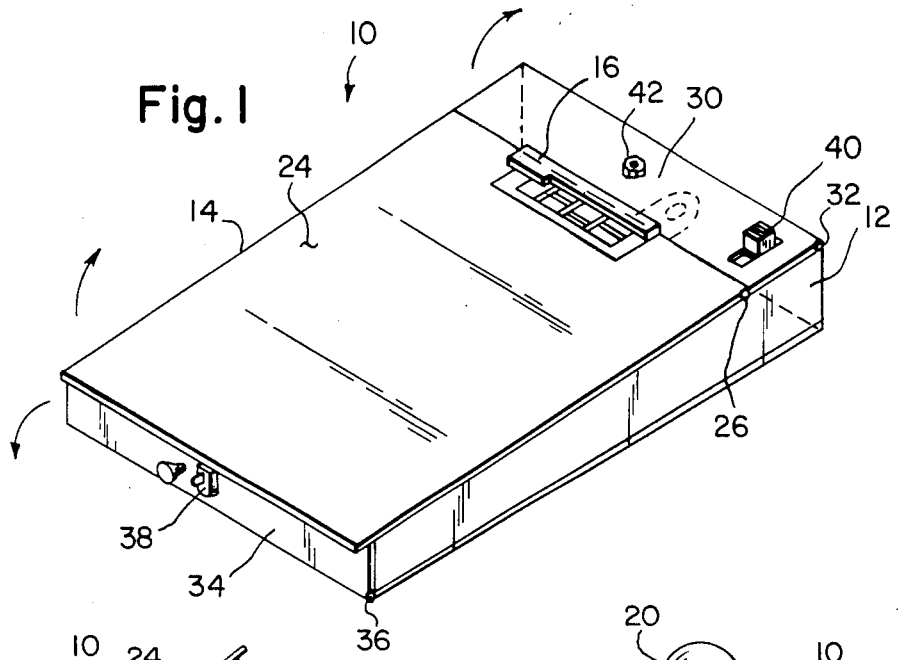
FIG. 1 is a perspective view of the invention with the lamp removed.
Figure 2:
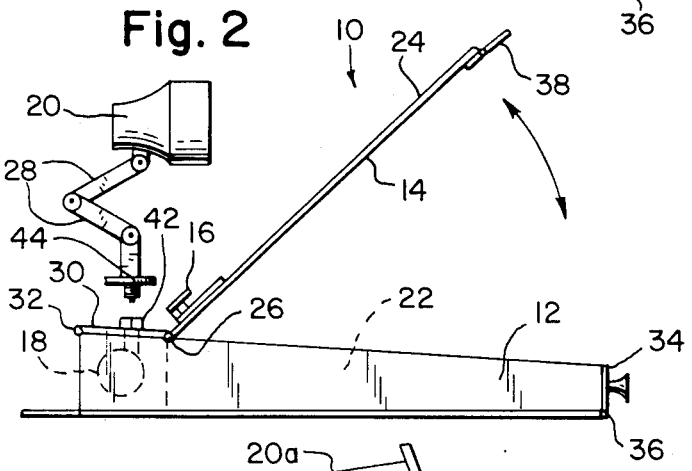
FIG. 2 is a side view with the lamp exploded therefrom and the top opened.
Figure 3:
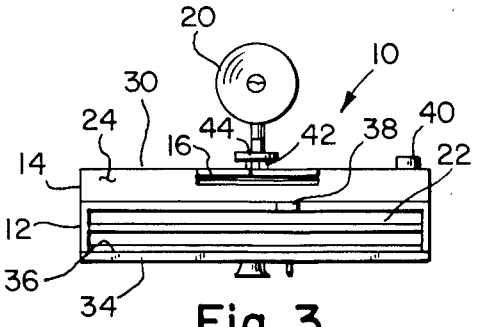
FIG. 3 is a front view with the door open showing the two compartments therein.

Turning now descriptively to the drawings, in which similar reference characters denote similar elements throughout the several views, FIGS. 1 through 3 illustrates a nite writer pad 10 that generally includes a body member 12, a cover 14, a spring loaded retainer clip 16, a battery 18 and a lamp 20.

The body member 12 has a storage compartment 22 for holding various types of writing equipment therein, such as paper clips and writing sheets. The cover 14 has a writing surface 24 and hinged at 26 upon the body member 12 to provide access to the storage compartment 22. The spring loaded retainer clip 16 is affixed to the cover 14 for releasably securing a writing sheet (not shown) to the writing surface 24. The battery 18 is placed within the body member 12 for providing a source of electrical current. The lamp 20 being manually activatable and adjustable by segments 28 is secured to the body member 12. The lamp is adapted to be energized by the battery 18 for selectively illuminating the writing sheet disposed on the writing surface 24 of the cover 14.

The nite writer pad 10 further contains a top flap 30 hinged at 32 behind the cover 14 upon the body member 12 to provide access to the battery 18. A front door 34 is hinged at 36 to the body member to provide further access to the storage compartment 22. A hasp 38 is used for holding the cover 14 and the front door 34 closed. A manually operable switch 40 is mounted on the top flap 30 and interposed in a circuit between the battery 18 and the lamp 20 for controlling energization of the lamp.

A female jack 42 that has internal threads is mounted on the top flap 30. A male jack 44 that has external threads is mounted to bottom of the lamp 20. The male jack 44 can be threaded and electrically connected to the female jack 42 making the lamp 20 removably secured thereto.

Figure 4:
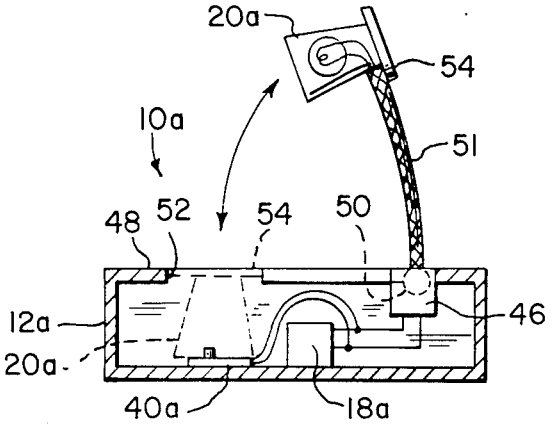
FIG. 4 is a cross sectional view of a modification showing a collapsible switch activated lamp.

FIG. 4 shows a modified nite writer pad **10*a* that contains a ball socket 46 mounted to top 48 of the body member 12*a* in rear of the cover and electrically connected to the battery 18*a*. A ball 50 is mounted to bottom of the flexible arm 51 of the lamp 20*a*. The ball 50 can be pivotly and electrically connected to the ball socket 46 making the lamp 20*a*** pivotly secured thereto.

Figure 5:
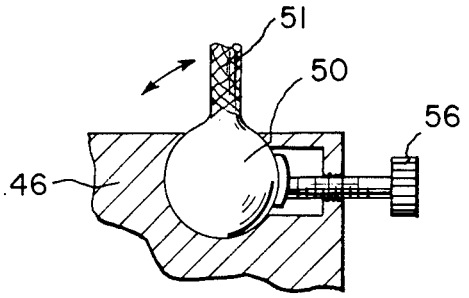
FIG. 5 is a cross sectional view of another modification showing the lamp having an adjustaably locking ball socket.

A normally closed button switch **40*a* is mounted within the body member 12*a* and interposed in a circuit between the battery 18*a* and the ball socket 46 for controlling energization of the lamp 20*a*. The top 48 of the body member 12*a* has an aperture 52 above the button switch 40*a* for receiving the lamp 20*a*. When the lamp is pivoted downwardly therein, as shown in dotted lines, the lamp will manually open the button switch 40*a* to deenergize the lamp 20*a*. When the lamp is pivoted upwardly therefrom the button switch 40*a* will close to energize the lamp. A plate 54 can be attached to rear of the lamp 20*a* so as to lie flat within the aperture 52 when the lamp is down. As shown in FIG. 5 a set screw 56 extends outwardly from side 58 of the ball socket for adjustably locking the ball 50 thereto and positioning the lamp 20*a***.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A nite writer pad which comprises:

(a) a body member having a storage compartment for holding various types of writing equipment therein;

(b) a cover having a writing surface and hinged upon said body member to provide access to said storage compartment;

(c) means affixed to said cover for releaseably securing a writing sheet to said writing surface;

(d) means within said body member for providing a source of electrical current;

(e) a manually activatable adjustable lamp secured to said body member and adapted to be energized by said source of electrical current means for selectively illuminating said writing sheet disposed on said writing surface of said cover; wherein said releaseably securing means is a spring loaded retainer clip; wherein said source of electrical current means is a battery, further comprising;

(f) a top flap hinged behind said cover upon said body member to provide access to said battery;

(g) a front door hinged to said body member to provide further access to said storage compartment;

(h) means for holding said cover and said front door closed; and a manually operable switch mounted on said top flap and interposed in a circuit between said battery and said lamp for controlling energization of said lamp.

2. A nite writer pad as recited in claim 1, further comprising:

(j) a female jack having internal threads mounted on said top flap; and (k) a male jack having external threads mounted to bottom of said lamp so that said male jack can be threaded and electrically connected to said female jack making said lamp removeably secured thereto.

3. A nite writer pad comprising:

(a) a body member having a storage compartment for holding various types of writing equipment therein;

(b) a cover having a writing surface and hinged upon said body member to provide access to said storage compartment;

(c) means affixed to said cover for releaseably securing a writing sheet to said writing surface;

(d) means within said body member for providing a source of electrical current;

(e) a manually activable adjustable lamp secured to said body member and adapted to be energized by said source of electrical current means for selectively illuminating said writing sheet disposed on said writing surface of said cover; wherein said releaseably securing means is a spring loaded retainer clip; wherein said source of electrical current means is a battery;

(f) a ball socket mounted to top of said body member in rear of said cover and electrically connected to said battery;

(g) a ball mounted to bottom of said lamp so that said ball can be pivotly and electrically connected to said ball socket making said lamp pivotly secured thereto;

(h) A normally closed button switch mounted within said body member and interposed in a circuit between said battery and said ball socket for controlling energization of said lamp; and (i) said top of said body member having an aperture above said button switch for receiving said lamp so that when said lamp is pivoted downwardly therein said lamp will manually open said button switch to de-energize said lamp and when said lamp is pivoted upwardly therefrom said button switch will close to energize said lamp.

4. A nite writer pad as recited in claim 3, further comprising a set screw extending outwardly from side of said ball socket for adjustably locking said ball thereto and positioning said lamp.

* * * * *